US008827823B1

(12) United States Patent
Sullivan et al.

(10) Patent No.: US 8,827,823 B1
(45) Date of Patent: Sep. 9, 2014

(54) LEVELING DEVICE FOR BILLIARD TABLE

(75) Inventors: Robert G. Sullivan, New Albany, IN (US); Chad D Scharlow, New Albany, IN (US)

(73) Assignee: Diamond Billiard Products, Inc., Jeffersonville, IN (US)

( * ) Notice: Subject to any disclaimer, the term of this patent is extended or adjusted under 35 U.S.C. 154(b) by 191 days.

(21) Appl. No.: 13/316,043

(22) Filed: Dec. 9, 2011

(51) Int. Cl.
*A47C 17/62* (2006.01)
*A63D 13/00* (2006.01)

(52) U.S. Cl.
USPC ..... 473/29; 473/33

(58) Field of Classification Search
USPC ..... 473/29, 4, 10, 31, 33; 108/8, 93, 95, 108/161; 248/188.2, 188.4
See application file for complete search history.

(56) References Cited

U.S. PATENT DOCUMENTS

| | | | | | |
|---|---|---|---|---|---|
| 372,566 | A | | 11/1887 | Rice | |
| 875,775 | A | | 1/1908 | Burhorn | |
| 921,651 | A | * | 5/1909 | Bracher | 473/29 |
| 2,524,961 | A | | 10/1950 | Cramer, Jr. | |
| 2,627,407 | A | * | 2/1953 | Acland | 473/29 |
| 3,837,298 | A | * | 9/1974 | Leonhart | 108/161 |
| 4,027,878 | A | * | 6/1977 | Dadbeh | 473/29 |
| 4,211,417 | A | | 7/1980 | Brown | |
| 4,686,773 | A | | 8/1987 | Brewer | |
| 4,805,358 | A | | 2/1989 | Fork | |
| 4,808,147 | A | | 2/1989 | Graham | |
| 4,989,863 | A | * | 2/1991 | Hall | 473/15 |
| 5,090,664 | A | | 2/1992 | McCullough et al. | |
| 5,161,797 | A | * | 11/1992 | Frasca | 473/29 |
| 5,249,767 | A | * | 10/1993 | Mellen | 248/188.2 |
| 5,839,966 | A | * | 11/1998 | Eisenhauer et al. | 473/29 |
| 5,882,265 | A | | 3/1999 | Benton | |
| 6,095,463 | A | | 8/2000 | McCormick | |
| 6,102,808 | A | | 8/2000 | Wong | |
| 6,132,320 | A | * | 10/2000 | Spoerl et al. | 473/29 |
| 6,234,451 | B1 | | 5/2001 | Baron | |
| 6,244,969 | B1 | * | 6/2001 | Murphy et al. | 473/29 |
| 7,223,177 | B2 | | 5/2007 | Tarbell | |
| 7,607,397 | B2 | * | 10/2009 | Berg | 108/8 |
| 7,621,818 | B1 | | 11/2009 | Tippit | |
| 7,654,911 | B2 | | 2/2010 | Cartwright | |
| 7,828,668 | B1 | | 11/2010 | Tippit | |
| 7,883,220 | B2 | | 2/2011 | Michimori et al. | |
| 2009/0270191 | A1 | * | 10/2009 | Cartwright | 473/33 |

* cited by examiner

*Primary Examiner* — Mitra Aryanpour
(74) *Attorney, Agent, or Firm* — Middleton Reutlinger; Robert H. Eichenberger; Chad D. Bruggeman

(57) ABSTRACT

A billiard table having a leveling system to level the slate bed by precise increments at predetermined locations. The leveling system includes a plurality of leveling devices each having a leveling wedge and a corresponding wedge incline of the table crossmember. A drive mechanism may be used to translate the leveling wedge relative to the crossmember wedge incline.

14 Claims, 7 Drawing Sheets

LEVELING DEVICE FOR BILLIARD TABLE

TECHNICAL FIELD

The present invention relates to a leveling system and device and particularly to a leveling device for use with a billiard table.

DETAILED DESCRIPTION

Figure 1:
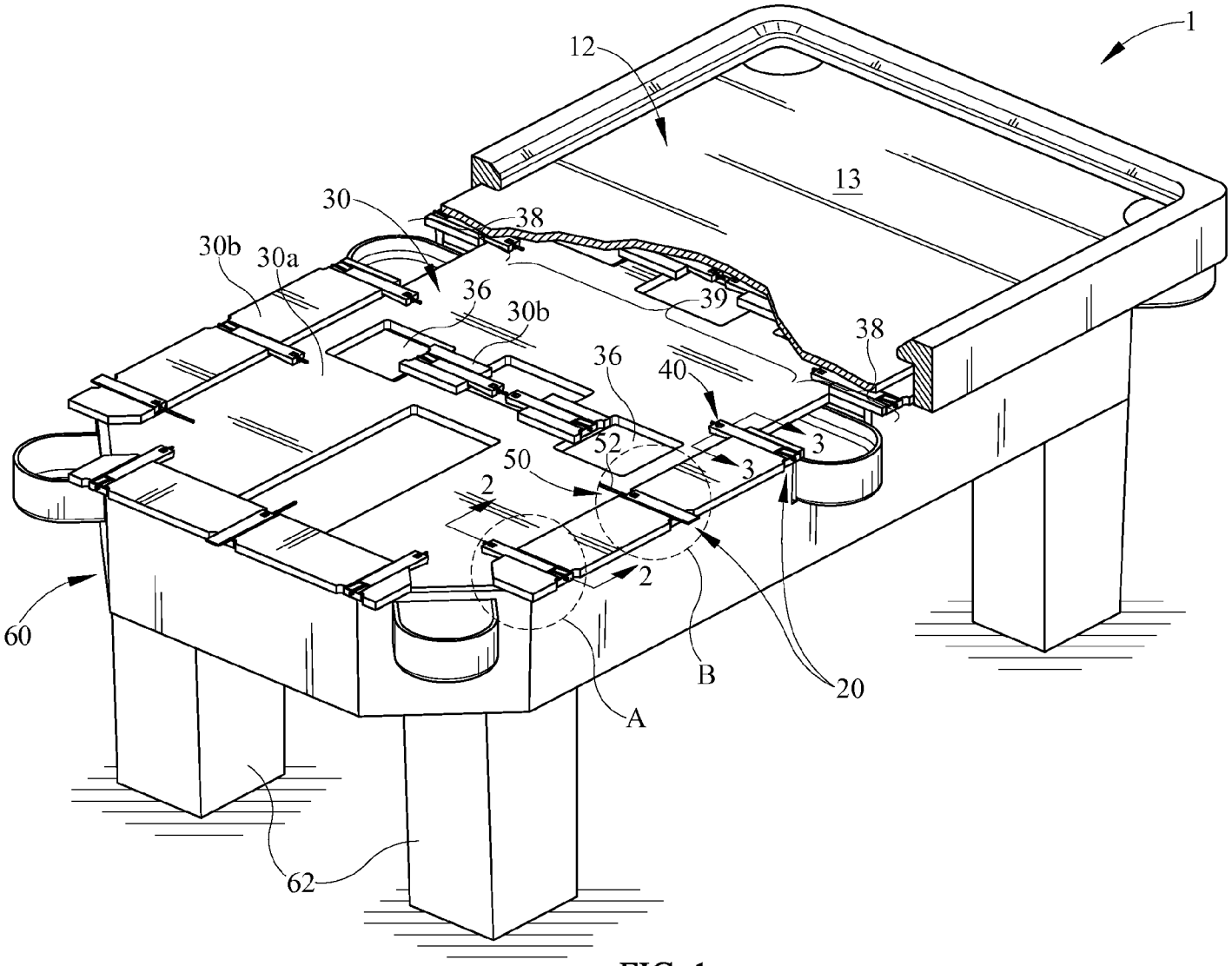
FIG. 1 shows a top perspective view of a billiard table, with portions of the billiard table partially broken away illustrating an embodiment of a leveling device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

As shown in FIG. 1, a billiard table 1 includes a table body 60, base structure, or box. A table crossmember 30 supporting a slate bed 12 is connected to the body. Slate bed 12 overlying crossmember 30 may be one or more slate sheets combining to form a planar playing surface 13. Table body 60 may include one or more supporting legs 62. The term "billiard table" is intended to include any table or playing surface of an object which is desired to be leveled or placed in a desired orientation to facilitate, enhance, or improve playability.

As shown in FIGS. 1-4, a plurality of leveling devices 20 are provided at selected locations about the top of table body 60. Each leveling device 20 may be expanded towards or away from slate bed 12 to raise, lower, or tip the slate to create an effective orientation of the slate bed to create a substantially horizontal playing surface 13. If a plurality of slate sheets is used, the leveling devices 20 are used to enable each sheet to reside in a common horizontal plane.

FIG. 1 illustrates possible locations of the plurality of leveling devices 20 for the table 1. A number of devices 20 are positioned along an outer periphery 38 of crossmember 30 or slate bed 12 and at interior portions 39 of crossmember 30 or slate bed 12. Each leveling device 20 along outer periphery 38 translates in a generally perpendicular direction to the outer periphery, while the leveling devices 20 at interior portions 39 of crossmember 30 may translate in any number of directions, depending on their locations and orientations in the interior portions 39. Operating access to the leveling devices 20 at interior portions 39 of crossmember 30 may be conducted through one or more apertures 36 within the crossmember 30. The leveling devices 20 along outer periphery 38 of crossmember 30 are operably accessed on an outer edge or outer edge recess of crossmember 30 along outer periphery 38. It should be understood that any number of devices may be used in a variety of positions and along various translational directions beneath slate bed 12 to effectively level the slate bed.

Figure 1B:
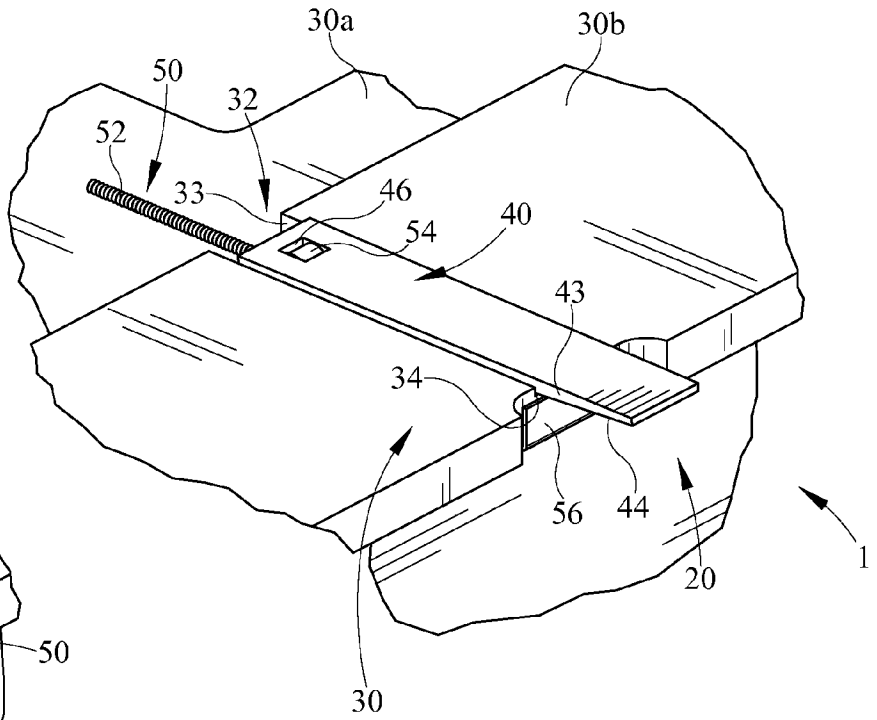
FIG. 1B shows an enlarged, top perspective view of detail B of FIG. 1.
Figure 1A:
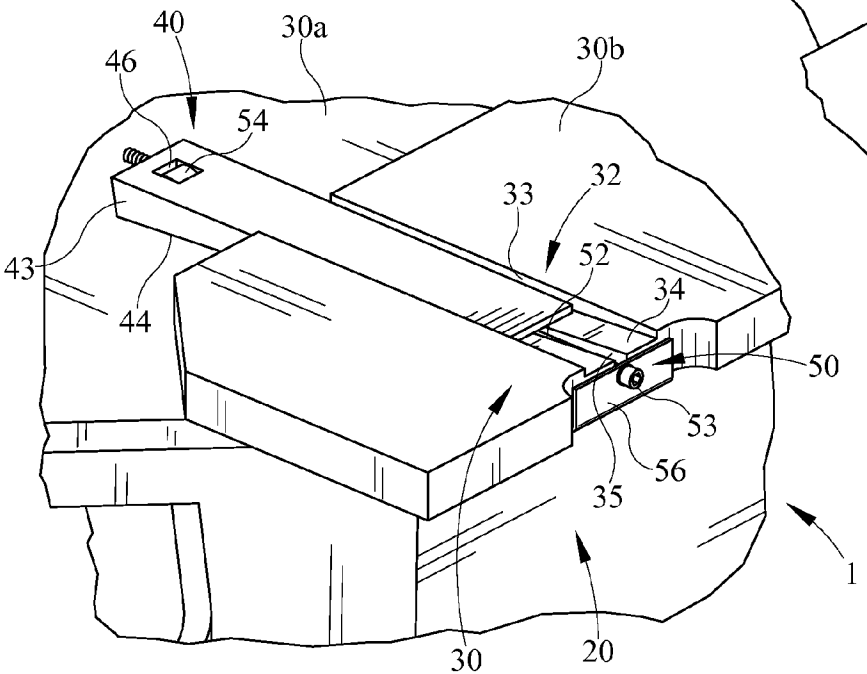
FIG. 1A shows an enlarged, top perspective view of detail A of FIG. 1.
Figure 2:
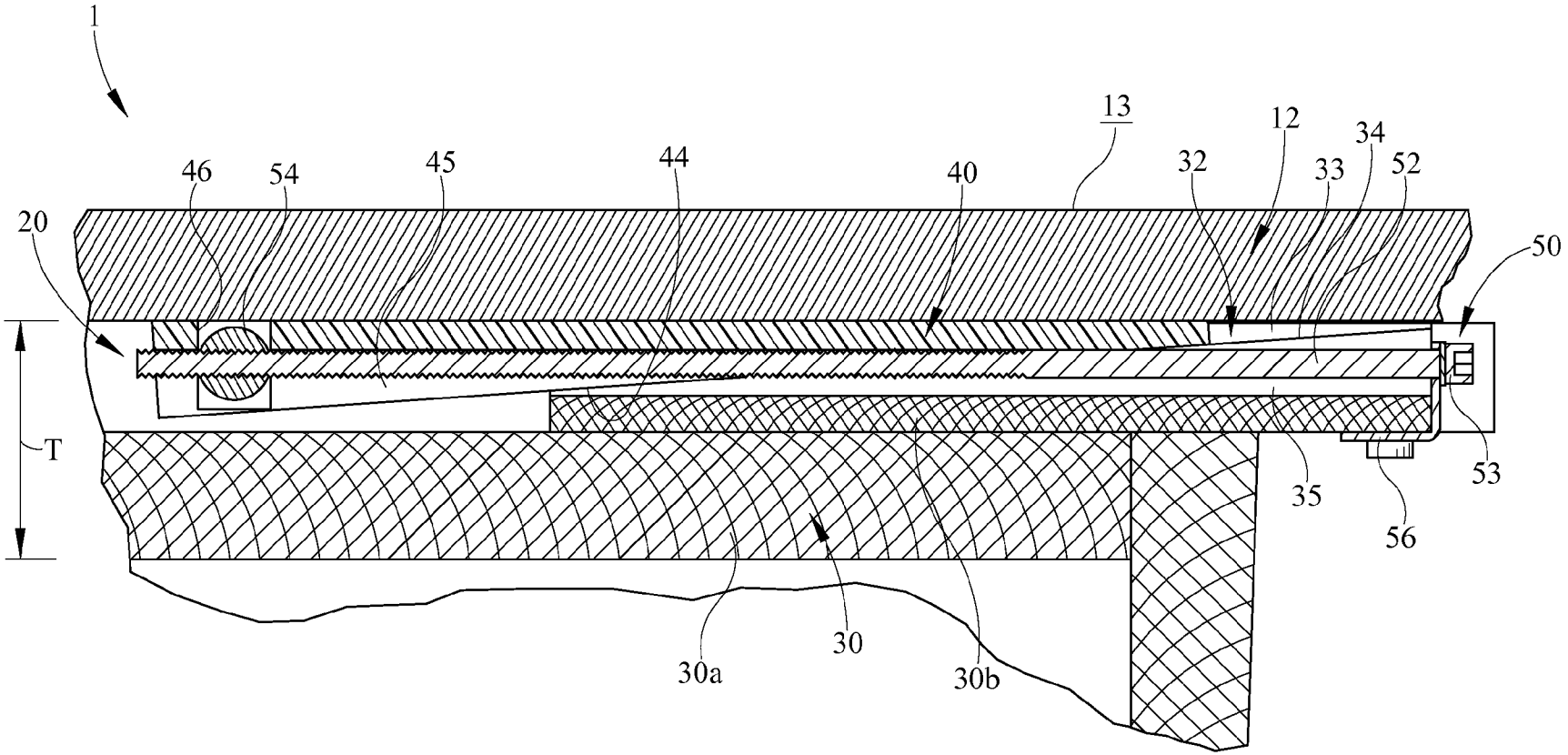
FIG. 2 shows a sectional view of the leveling device embodiment of FIG. 1 taken along line 2-2.
Figure 3:
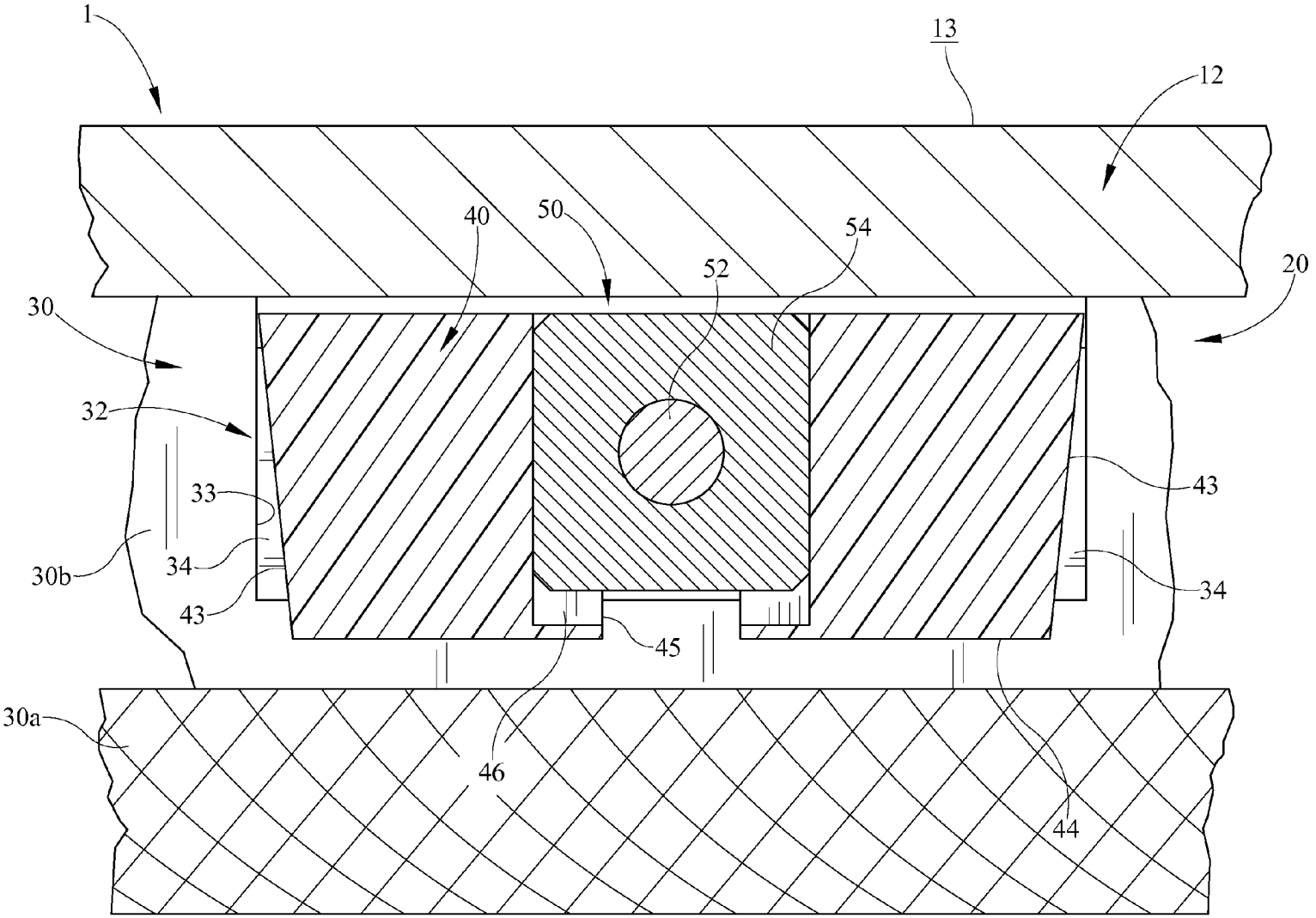
FIG. 3 shows a sectional view of the leveling device embodiment of FIG. 1 taken along line 3-3.
Figure 4:
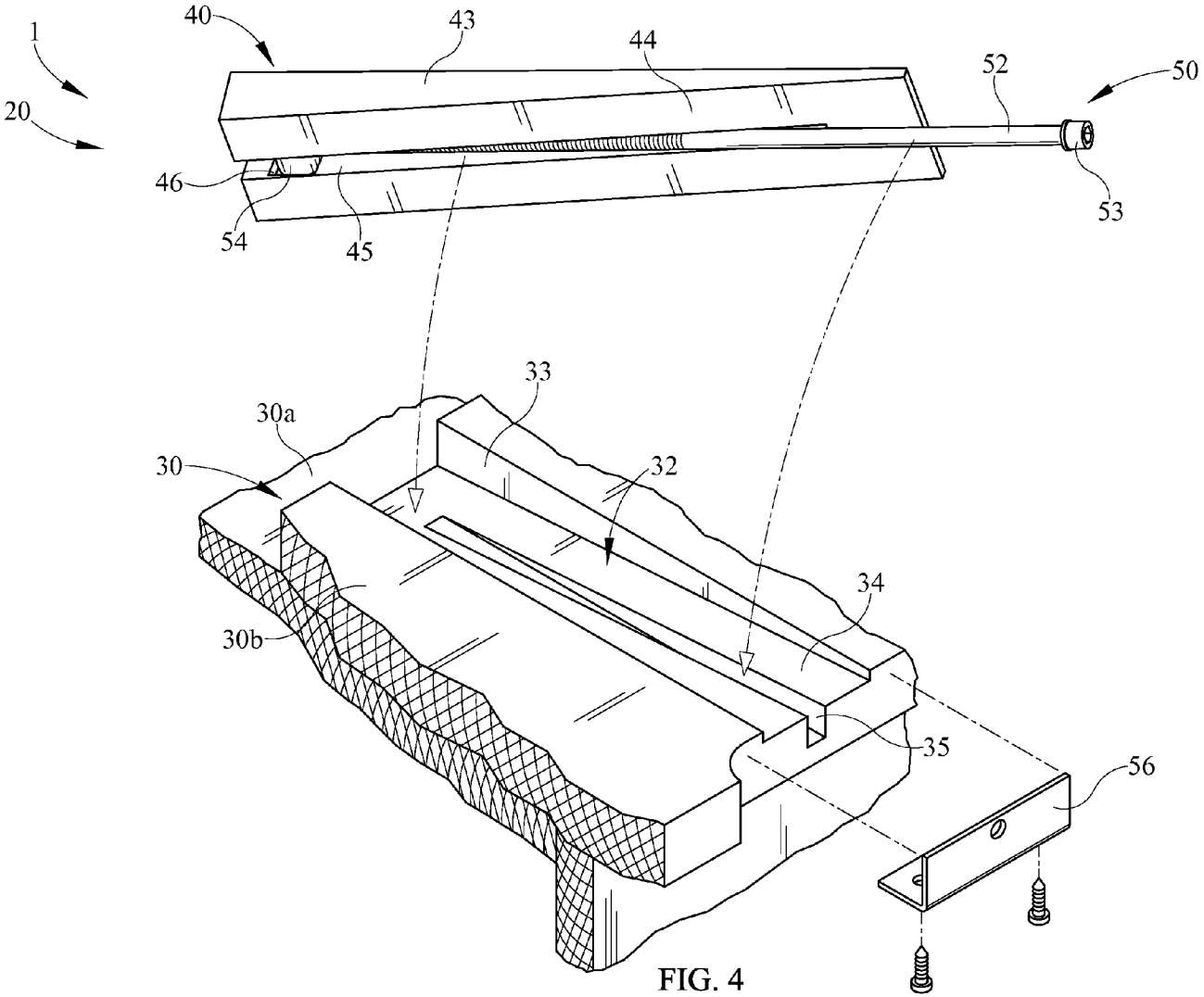
FIG. 4 shows an enlarged, top perspective view of the crossmember of FIG. 1, with portions of the leveling device exploded away.
Figure 5:
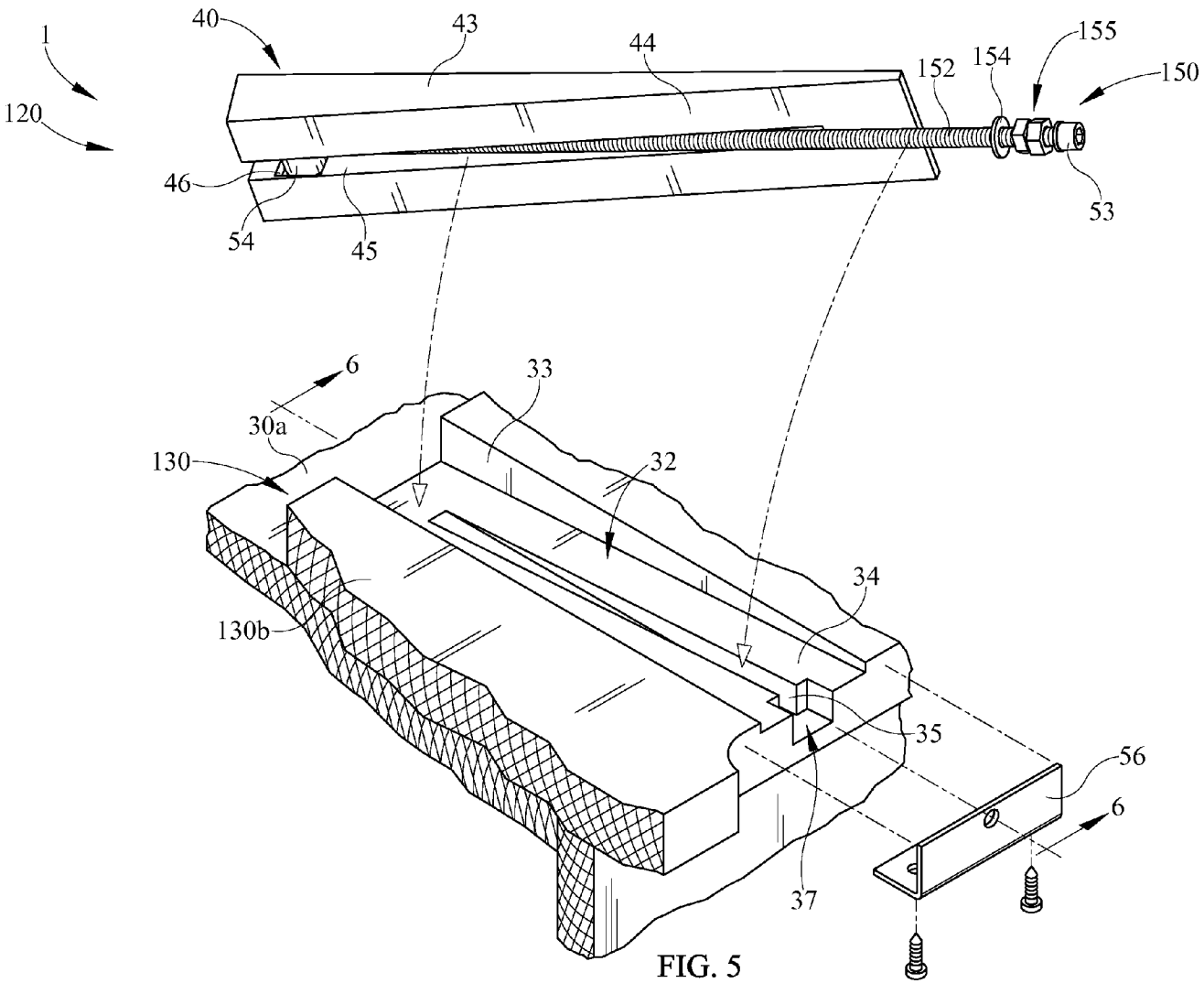
FIG. 5 shows an enlarged, top perspective view of another embodiment of a leveling device, with portions of the leveling device exploded away.
Figure 6:
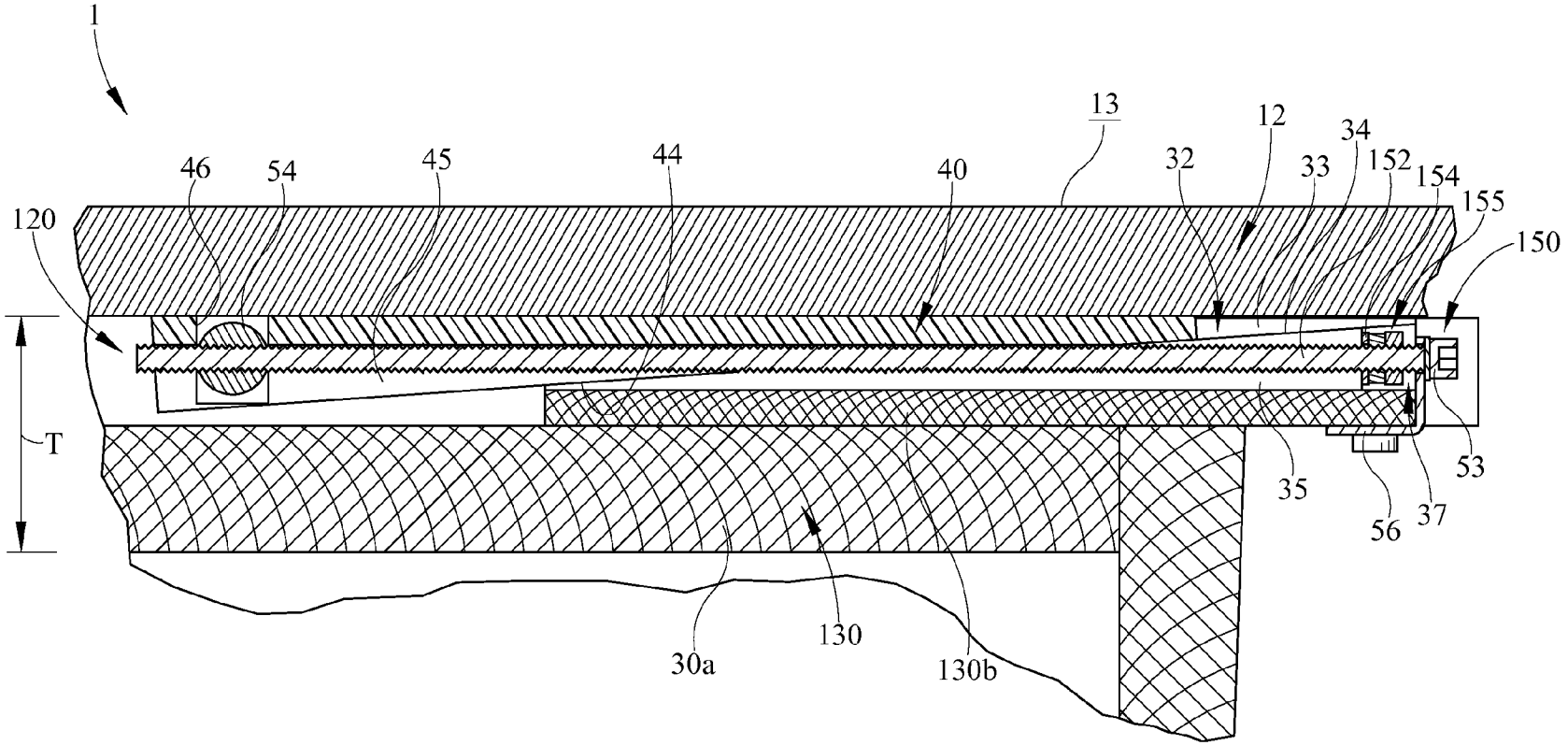
FIG. 6 shows a sectional view of the leveling device embodiment of FIG. 5 taken along line 6-6.

As shown in FIGS. 1-4, each leveling device 20 includes a leveling wedge 40 in a translational engagement with crossmember 30. Crossmember 30 may have a lower section 30*a* and an upper section 30*b*. Leveling wedge 40 is laterally held within an inclined channel or recess 32 of crossmember 30, or more specifically, upper section 30*b*. A ramp or incline 44 of leveling wedge 40 slides upon a ramp or incline 34 of crossmember recess 32 whereby an upper surface of the leveling wedge 40 ascends or descends relative to the crossmember 30. The recess sidewalls 33 of inclined recess 32 laterally abut the leveling wedge sidewalls 43. Leveling wedge sidewalls 43 may taper towards the ramp 44 as shown more clearly in FIG. 3, whereby wedge sidewalls 43 are dissimilar from the substantially vertical sidewalls 33 of recess 32. Detail A of FIGS. 1 and 1A illustrates a leveling device 20 whereby the vertical distance, height, or thickness T is smaller than leveling device 20 of detail B of FIGS. 1 and 1B where leveling wedge 40 has ascended up the crossmember ramp 34. As a result, when the thickness T increases or decreases at any given device 20, the slate bed 12 in the vicinity of that device 20 will rise or lower (tilt), respectively. When leveling device 20 is assembled, leveling wedge ramp 44 includes a groove or channel 45 to receive an adjusting or threaded bolt 52 and continues to project through a groove or channel 35 of recess ramp 34 and whose bolt head 53 may project and extend through a thrust plate 56. The opposing end of the head 53 is received by a barrel or threaded nut 54 retained within a notch 46 of leveling wedge 40. Thrust plate 56 connects to crossmember 30 and provides, at a minimum, a surface for the forces to be applied to as a result of rotating the threaded bolt and actuating the leveling device. The head 53 of threaded bolt 52 may be turned or rotated in the proper direction to pull or push the leveling wedge 40 relative to crossmember 30. Specifically, rotating the bolt 52 counterclockwise pulls wedge 40 up the recess ramp 34 thus raising slate bed 12 in that predetermined area, while rotating the bolt 52 in the opposite direction and applying a force to the wedge 40 lowers the wedge and allows the slate bed 12 to be lowered in that predetermined area. The threaded bolt 52 and nut 54 engagement within the leveling device 20 is but one example of the drive mechanism 50 that may be used to translate the leveling wedge 40 relative to the crossmember recess 32. It is to be understood that a variety of drive mechanisms 50 may be used to operably engage the leveling wedge and crossmember recess. For example as shown in FIGS. 5 and 6, a leveling device 120 may include another embodiment of a drive mechanism 150 to eliminate the need for additional force applied by the user to the wedge 40 while rotating the bolt 152 in a direction which lowers the wedge and allows the slate bed 12 to be lowered in that predetermined area. Drive mechanism 150 includes a washer 154 and a double nut engagement 155 axially fixed upon the bolt 152 and both are received within a recess 37 of upper section 130*b* of crossmember 130. The axially fixed double nut engagement 155 upon the bolt 152 prevents the bolt from being withdrawn from the crossmember 130. Although a double nut engagement 155 is shown in FIGS. 5 and 6, it should be understood that a variety of devices may be axially fixed upon the bolt 152 and spaced from bolt head 53, such as a fixed flange or collar possibly welded to the bolt shaft, to enable rotation which lowers the wedge 40. It should also be understood that crossmember 30 may be of a variety of constructions, dimensions, and quantities underneath slate bed 12.

It should be understood that the leveling device 20 may be provided in a variety of positions, quantities, constructions, and dimensions and still permit raising and lowering the slate bed at predetermined locations.

In use, crossmember 30 is machined with the inclined recesses 32 and later receives the leveling wedge 40 and possibly the drive mechanism 50. Once the leveling devices 20 are assembled, the slate bed 12 is overlaid and the remaining table is fully completed. The billiard table 1 may then be "rough leveled" by a leveling device inside each leg, afterwards the table is leveled by adjusting one or more leveling devices 20 at predetermined locations. The leveling devices 20 allow for precise changes in raising or lowering the slate bed 12 with precision on the order of about several thousandths of an inch (e.g. on the order of 0.001) of vertical movement. The leveling devices 20 may allow for more precise increments than the leveling devices of the legs. Checking the level of the slate bed continues until the table is effectively leveled for play.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A billiard table comprising:

a billiard table having a slate bed overlying a table crossmember, said crossmember supported by a table base;

said crossmember having a top planar surface having a plurality of inclined recesses positioned at predetermined locations on said crossmember; and a leveling wedge received by each of said plurality of inclined recess, wherein said leveling wedge is vertically positioned between a first position and a second position within each of said inclined recess, wherein said second position is located along the incline away from said first position, wherein the combined thickness of said leveling wedge and said crossmember forms a first thickness at said first position which is smaller than the combined thickness of said leveling wedge and said crossmember at said second position and wherein the corresponding slate bed overlying the combined thickness of said leveling wedge and said crossmember can be selectively raised or lowered to level said slate bed at said predetermined locations.

2. The billiard table as in claim 1 wherein said leveling wedge is laterally restricted within said inclined recess.

3. The billiard table as in claim 1 further including a drive mechanism positioning said leveling wedge between said first position and said second position.

4. The billiard table as in claim 3 wherein said drive mechanism is a screw drive mechanism.

5. The billiard table as in claim 4 wherein said screw drive mechanism includes a threaded bolt rotatably engaging said crossmember and a threaded nut, said leveling wedge includes a notch receiving said threaded nut.

6. The billiard table as in claim 1 wherein said table base includes one or more legs, wherein said one or more legs include a leveling device.

7. A billiard table comprising:

a billiard table having a slate bed positioned above a table crossmember, said table crossmember including a wedge incline;

a plurality of leveling devices underlying said slate bed at predetermined locations on said crossmember;

each of said plurality of leveling devices includes a leveling wedge operably engaging said wedge incline of said crossmember; and a threaded screw drive for translating each of said leveling wedges along a length of said crossmember wedge incline thereby selectively raising or lower said slate bed at said predetermined locations.

8. The billiard table as in claim 7 wherein said wedge incline is a recess within said crossmember.

9. The billiard table as in claim 8 wherein each of said leveling wedge and said recess of said crossmember wedge incline includes corresponding sidewalls dissimilar in shape.

10. The billiard table as in claim 7 wherein said leveling wedge receives a nut threaded with said threaded screw drive thereby rotation of said screw drive translates said leveling wedge relative to said crossmember.

11. The billiard table as in claim 7 wherein one of said plurality of leveling devices is positioned adjacent an outer periphery of said crossmember.

12. The billiard table as in claim 11 wherein said threaded screw drive translates said leveling wedge in a direction substantially perpendicular to said outer periphery of said crossmember.

13. The billiard table as in claim 7 wherein one of said plurality of leveling devices is positioned at an interior position of said crossmember.

14. The billiard table as in claim 7 wherein said leveling device vertically moves said slate bed in increments of about 0.001 inches.

* * * * *